US007209099B2

(12) United States Patent
Roh et al.

(10) Patent No.: US 7,209,099 B2
(45) Date of Patent: Apr. 24, 2007

(54) APPARATUS AND METHOD OF DRIVING HIGH-EFFICIENCY PLASMA DISPLAY PANEL

(75) Inventors: Chung-wook Roh, Seoul (KR); Sang-hoon Lee, Seoul (KR); Hye-jeong Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 574 days.

(21) Appl. No.: 10/673,417

(22) Filed: Sep. 30, 2003

(65) Prior Publication Data

US 2004/0113870 A1 Jun. 17, 2004

(30) Foreign Application Priority Data

Nov. 8, 2002 (KR) ..... 10-2002-0069256

(51) Int. Cl.
*G09G 3/28* (2006.01)

(52) U.S. Cl. ..... 345/60; 315/169.4

(58) Field of Classification Search ..... 345/60–72; 315/169.4

See application file for complete search history.

(56) References Cited

U.S. PATENT DOCUMENTS 5,642,018 A * 6/1997 Marcotte ..... 315/169.4
5,808,420 A * 9/1998 Rilly et al. ..... 315/169.4
6,897,834 B2 * 5/2005 McCormack ..... 345/55

* cited by examiner

*Primary Examiner*—Alexander Eisen
(74) *Attorney, Agent, or Firm*—Sughrue Mion, PLLC

(57) ABSTRACT

Provided are an apparatus and a method of driving a high-efficiency plasma display panel for quickly eliminating a free-wheeling current, generated due to the parasitic effect in an energy recovery circuit, thereby improving energy recovery efficiency. The sustain-discharge driving device of a high-efficiency plasma display panel (PDP) includes a sustain-discharge switching unit, which connects charging and discharging paths of an energy recovery unit to the PDP according to a sustain-discharge sequence, and includes an energy recovery unit which, according to an energy recovery sequence, discharges energy of the PDP to an energy accumulation device through a resonance path while in discharging mode, charges the PDP with the energy accumulated in the energy accumulation device through a resonance path while in charging mode, and forms a closed circuit in which the voltage difference between both ends of an inductor is greater than a predetermined value so as to eliminate a free-wheeling current, which is generated in the inductor of the resonance path due to a parasitic effect, during mode transition.

21 Claims, 14 Drawing Sheets

(MODE 3)

(MODE 4)

(MODE 1)

(MODE 2)

(MODE 3)

(MODE 4)

(MODE 5)

(MODE 6)

(MODE 7)

(MODE 8)

APPARATUS AND METHOD OF DRIVING HIGH-EFFICIENCY PLASMA DISPLAY PANEL

BACKGROUND OF THE INVENTION

This application claims priority from Korean Patent Application No. 2002-69256, filed on Nov. 8, 2002, in the Korean Intellectual Property Office, the disclosure of which is incorporated herein in its entirety by reference.

1. Field of the Invention

The present invention relates to an apparatus and a method of driving a plasma display panel (PDP), and more particularly, to an apparatus and a method of driving a high-efficiency PDP for quickly eliminating a free-wheeling current, which is generated due to the parasitic effect in an energy recovery circuit, and improving the energy recovery efficiency.

2. Description of the Related Art

In general, a plasma display panel (PDP) is a flat display for displaying characters or images using plasma generated by gas discharge. Pixels ranging from several hundreds of thousands to more than millions, according to the size of the PDP, are arranged in the form of a matrix.

FIG. 1 shows a conventional alternating current (AC)-PDP sustain-discharge driver suggested by L. F. Weber, which includes an energy recovery unit with a clamping diode for suppressing the surge voltages of switches $S_r$, $S_s$, $S_f$, and $S_d$. The panel is assumed to have capacitor $C_p$ as a load to analyze PDP driving circuit. FIG. 2 shows graphs of an output panel voltage $V_p$ and a current $I_L$ flowing through an inductor L, according to a switching sequence. The AC-PDP sustain-discharge driver operates in the following four modes, according to the switching sequence.

1) Mode 1

A both-end panel voltage $V_p$ is sustained at 0V when a switch $S_{x2}$ (not shown; a metal-oxide-semiconductor field effect transistor (MOSFET) corresponding to the switch $S_d$ of a side 2 sustain-discharge driver) is turned on just before the switch $S_r$ functioning as the MOSFET is turned on. Once the switch $S_r$ is turned on, the AC-PDP sustain-discharge driver begins to operate in mode 1. In mode 1, an LC resonance circuit is formed through a path of the energy recovery capacitor $C_c$, the switch $S_r$, the diode $D_r$, the inductor L, and the capacitor $C_p$, as shown in FIG. 3A. Therefore, the current $I_L$ flows through the inductor L and the output voltage $V_p$ of the panel increases. As a result, the current $I_L$ flowing through the inductor L becomes 0A, and the output voltage $V_p$ of the panel becomes voltage $+V_{pk}$.

2) Mode 2

In mode 2, the switch $S_r$ is turned off, and the switch $S_s$ is turned on. The both-end voltage at switch $S_s$ is changed from the voltage $+V_{pk}$ to the voltage $+V_s$, which causes switching voltage loss. The voltage difference between the voltage $+V_{pk}$ and the voltage $+V_s$ is due to the parasitic components of the driver, such as parasitic capacitors or parasitic resistances. As shown in FIG. 3B, this voltage difference between the voltage $+V_{pk}$ and the voltage $+V_s$ causes a free-wheeling current that flows through a path of the switch $S_s$, the inductor L, and the diode $D_1$. As shown in FIG. 2, the free-wheeling current decreases slowly because the both-end voltage at inductor L becomes about 2V, i.e., the voltage drop level of the diode $D_1$ and the switch $S_s$. In mode 2, the output voltage $V_p$ of the panel is sustained at the voltage $+V_s$, and the discharge of the panel is sustained.

3) Mode 3

In mode 3, the switch $S_f$ is turned on and the switch $S_s$ is turned off. The LC resonance circuit is formed through a path of the capacitor $C_p$, the inductor L, the diode $D_f$, the switch $S_f$, and the energy recovery capacitor $C_c$. Therefore, the current $I_L$ flows through the inductor L, and the output voltage $V_p$ of the panel decreases. As a result, the current $I_L$ flowing through the inductor L becomes 0 A and the output voltage $V_p$ of the panel becomes equal to the voltage difference between the voltage $+V_{pk}$ and the voltage $+V_s$.

4) Mode 4

In mode 4, the switch $S_d$ is turned on and the switch $S_f$ is turned off. The both-end voltage at switch $S_d$ is changed from the voltage $V_s-V_{pk}$ into 0V rapidly, which causes switching loss. The voltage difference between the voltage $+V_{pk}$ and the voltage $+V_s$ is due to the parasitic components of the driver, such as parasitic capacitors or parasitic resistances. As shown in FIG. 3D, this voltage difference between the voltage $+V_{pk}$ and the voltage $+V_s$ causes the free-wheeling current which flows through a path of the diode $D_2$, the inductor L, and the switch $S_d$. As shown in FIG. 2, the free-wheeling current decreases slowly because both-end voltage at the inductor L becomes about 2V, i.e., the voltage drop level of the diode $D_2$ and the switch $S_d$.

Thereafter, the switch $S_{x2}$ is turned off, and a switch $S_{x1}$ (not shown; a MOSFET corresponding to the switch $S_r$ of a side 2 sustain-discharge driver) is turned on. Then, the process returns to the operation of mode 1, and the operations of mode 1 through 4 are repeated.

However, the free-wheeling current generated in the AC-PDP sustain-discharge driver causes the following problems.

First, since the free-wheeling current is very strong, i.e., about 30 A, it increases the stress which is applied to components through which the free-wheeling current flows, such as the switch $S_s$, the switch $S_d$, the inductor L, the diode $D_1$, and the diode $D_2$. As a result, high-current standard components must be used in the driver, which increases the size and production cost of the driver.

Second, the free-wheeling current increases the power consumption of the AC-PDP sustain-discharge driver.

Third, the free-wheeling current makes it difficult to control the timing sequence on the rising and falling edges of the output voltage $V_p$ of the panel. In other words, the free-wheeling current hinders the timing sequence control of a gate signal.

SUMMARY OF THE INVENTION

The present invention provides an apparatus and a method of driving a high-efficiency plasma display panel (PDP) for quickly eliminating a free-wheeling current which is generated due to the parasitic effect in the switching sequence of an energy recovery unit.

According to an aspect of the present invention, there is provided a sustain-discharge driving device of a high-efficiency plasma display panel (PDP). The sustain-discharge driving device comprises a sustain-discharge switching unit that connects charging and discharging paths of an energy recovery unit to the PDP, according to a sustain-discharge sequence. The energy recovery unit, according to an energy recovery sequence, discharges energy of the PDP to an energy accumulation device through a resonance path while in discharging mode, charges the PDP with the energy accumulated in the energy accumulation device through a resonance path while in charging mode, and forms a closed circuit in which a voltage difference between both ends of an inductor is greater than a predetermined value, so as to eliminate a free-wheeling current, which is generated in the inductor of the resonance path due to a parasitic effect, during mode transition.

According to another aspect of the present invention, there is provided a plasma display panel (PDP) driving system which repeats reset, address, and sustain-discharge periods according to a switching sequence. The PDP driving system comprises a Y electrode sustain-discharge driving circuit, a separation and reset circuit, a scan pulse generating circuit, and an X electrode sustain-discharge driving circuit. The Y electrode sustain-discharge driving circuit applies a high frequency voltage of rectangular waveform to a Y electrode of the PDP, by dividing a charging mode into a first charging mode and a second charging mode, and by dividing a discharge mode into a first discharging mode and a second discharging mode, directs the Y electrode of the PDP to be charged and/or discharged through a resonance path caused by different inductors in the first and second charging modes, and in the first and second discharging modes, and includes a closed circuit in which a voltage difference between both ends of an inductor is greater than a predetermined value so as to eliminate a free-wheeling current, which is generated in the inductor of the resonance path due to a parasitic effect, during mode transition. The separation and reset circuit separates circuit operations, during the sustain period, from circuit operations, during other periods such as the address period and the reset period, and applies a ramp-type high voltage to the PDP during the reset period. The scan pulse generating circuit applies a horizontal synchronization signal during the address period, which is shortened during the other periods. The X electrode sustain-discharge driving circuit applies a high frequency voltage of rectangular waveform to an X electrode of the PDP, by dividing a charging mode into a first charging mode and a second charging mode and by dividing a discharging mode into a first discharging mode and a second discharging mode, directs the first and second charging modes, and in the first and second discharging modes to charge and/or discharge the Y electrode of the PDP through a resonance path including different inductors, and includes a closed circuit in which a voltage difference between both ends of an inductor is greater than a predetermined value, so as to eliminate a free-wheeling current, which is generated in the inductor of the resonance path due to a parasitic effect, during mode transition.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which preferred embodiments of the invention are shown.

Figure 1:
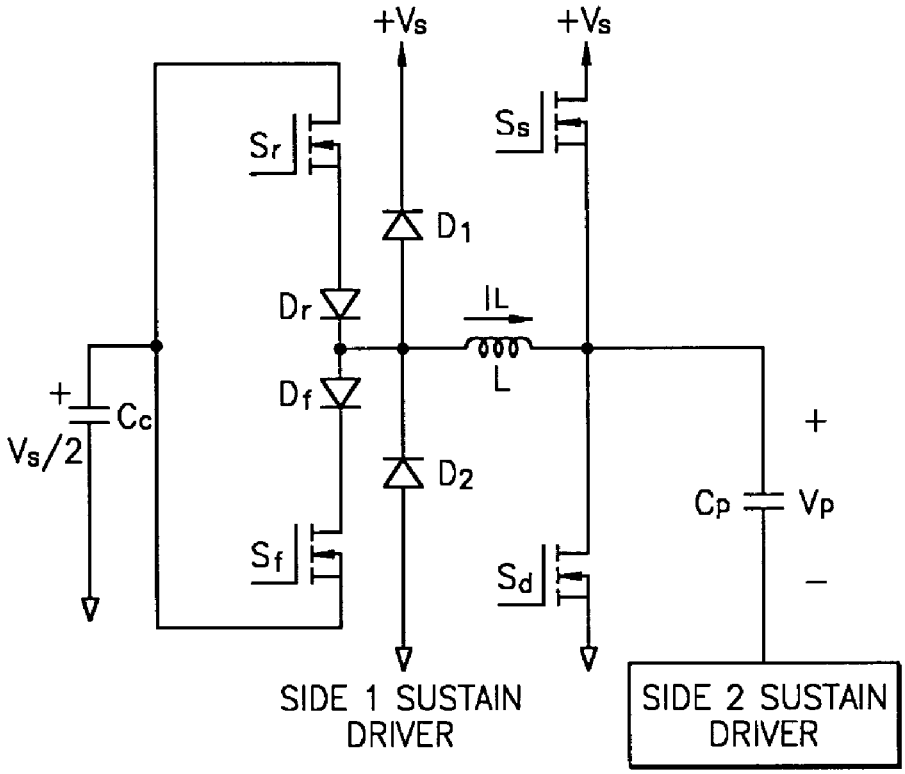
FIG. 1 (PRIOR ART)
FIG. 1 shows a conventional plasma display panel (PDP) sustain-discharge driver.
Figure 2:
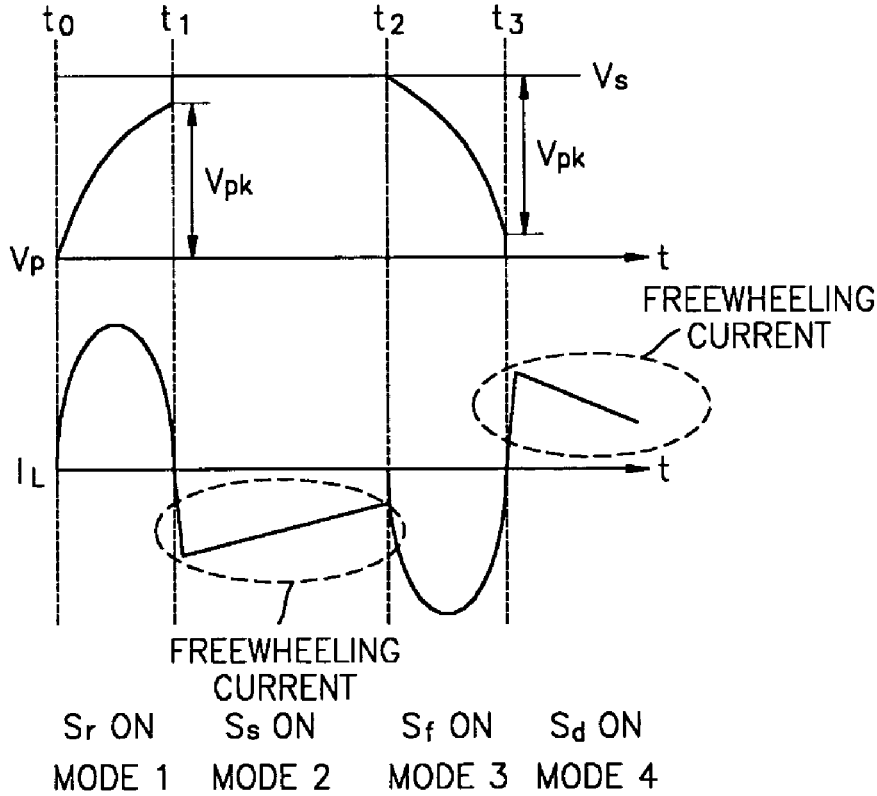
FIG. 2 shows graphs of an output voltage $V_p$ of the PDP and a current $I_L$ flowing through an inductor L, according to the switching sequence of an energy recovery unit, in each mode of the conventional PDP sustain-discharge driver of FIG. 1.
Figure 3A:
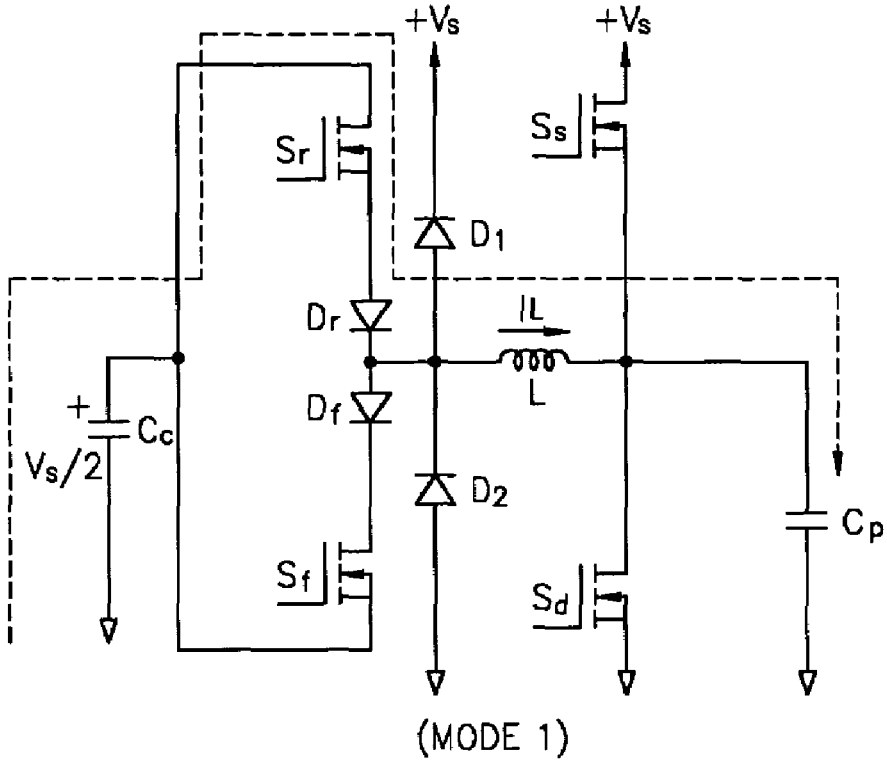
FIG. 3A (PRIOR ART)
FIGS. 3A through 3D show paths through which current flows according to the switching sequence of the energy recovery unit, in each mode of the conventional PDP sustain-discharge driver of FIG. 1.
Figure 3B:
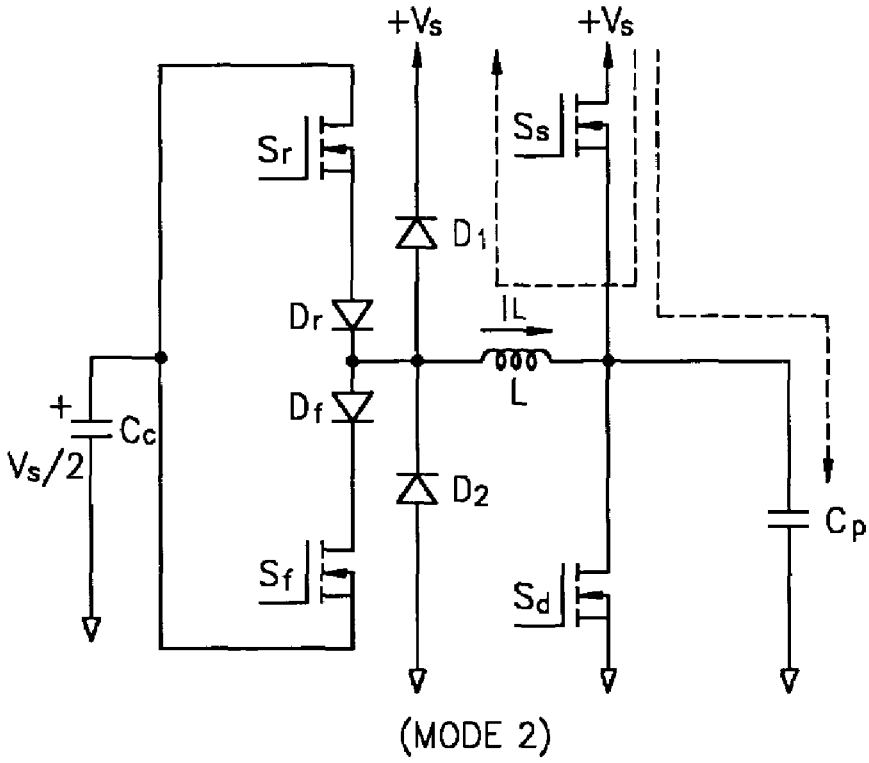
FIG. 3B (PRIOR ART)
Figure 3C:
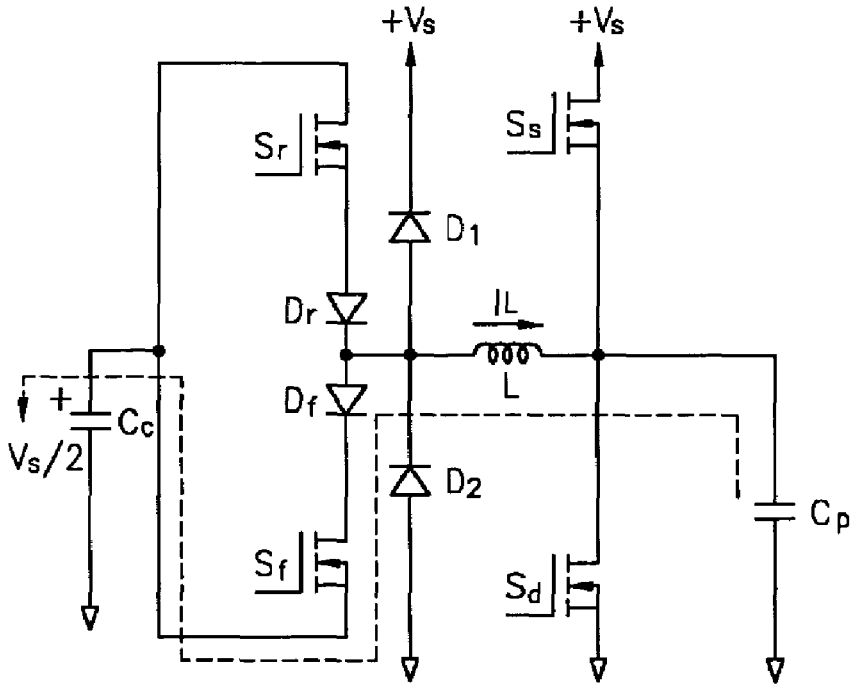
FIG. 3C (PRIOR ART)
Figure 3D:
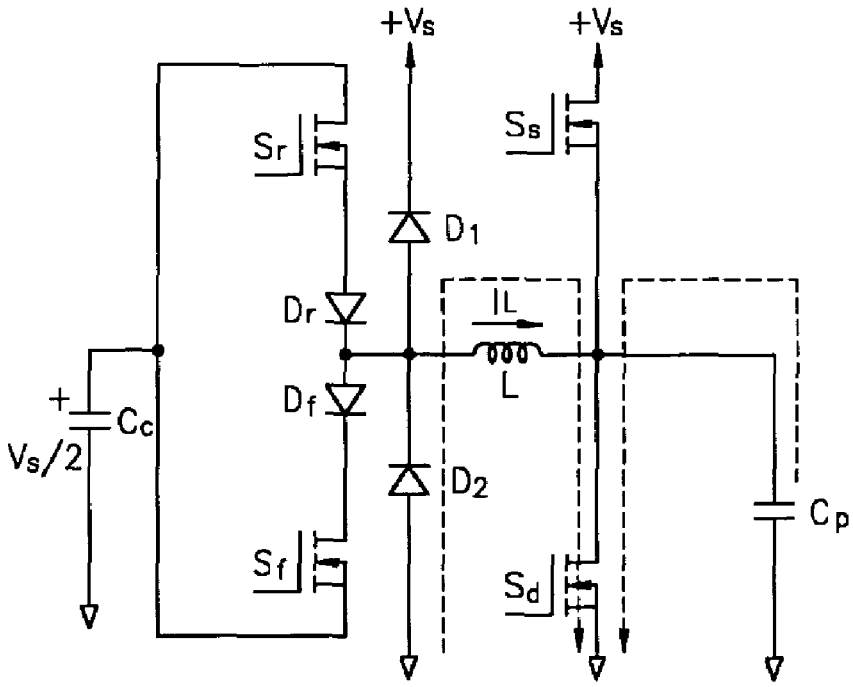
FIG. 3D (PRIOR ART)
Figure 4:
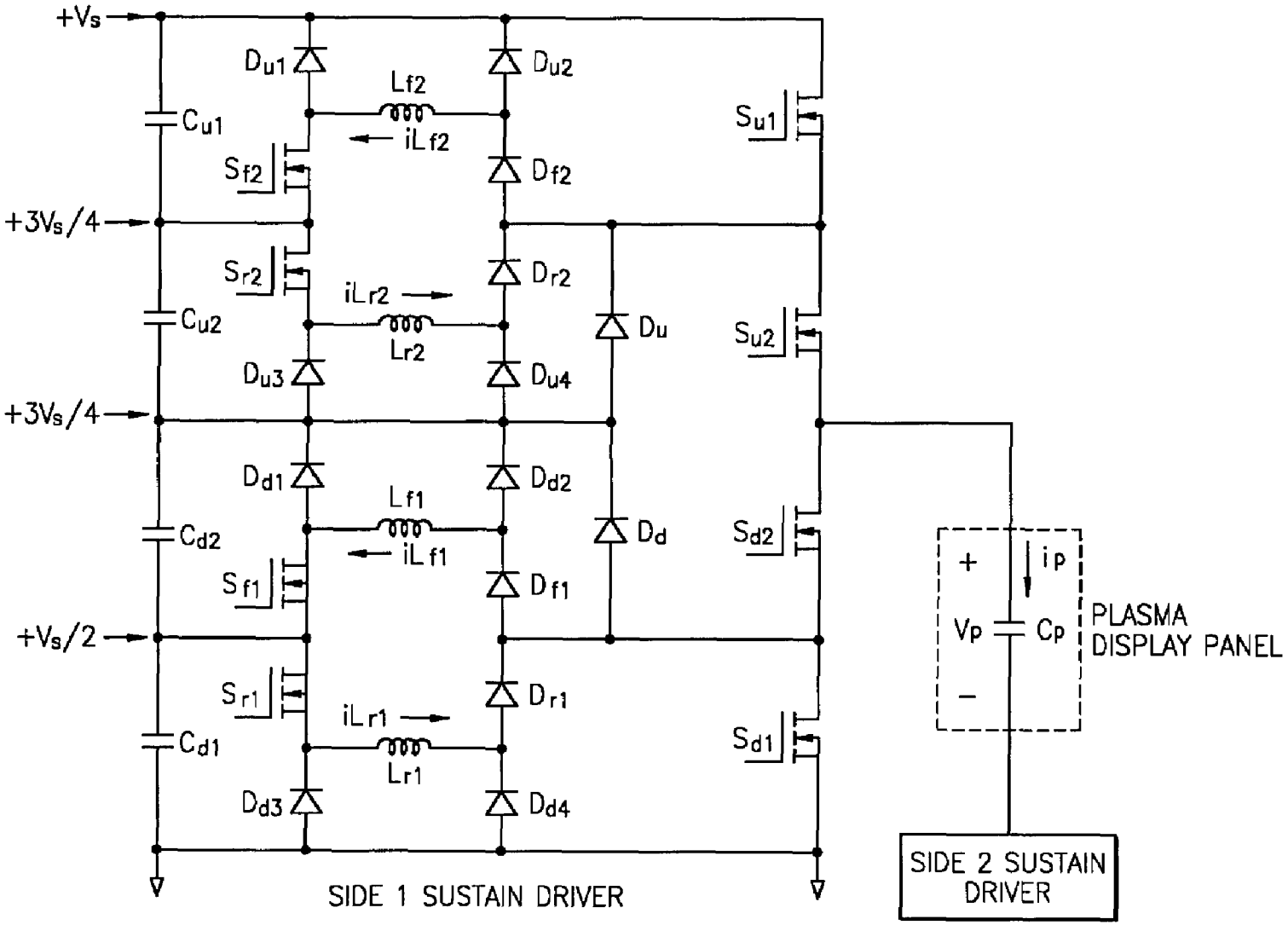
FIG. 4 shows a sustain-discharge driving device of a high-efficiency PDP according to the present invention.

As shown in FIG. 4, a sustain-discharge driving device of a high-efficiency plasma display panel (PDP) according to the present invention includes a sustain-discharge switching unit, an energy recovery unit, and a plasma display panel (PDP).

The sustain-discharge switching unit includes four switches $S_{d1}$, $S_{d2}$, $S_{u2}$, and $S_{u1}$ that are connected in series. One end of the switch $S_{d1}$ is connected to a ground line. One end of the switch $S_{u1}$ is connected to a supply voltage $+V_s$. A contact point of the switches $S_{d2}$ and $S_{u2}$ is connected to a PDP ($C_p$). A contact point of the switch $S_{d1}$ and the switch $S_{d2}$, and a contact point of the switch $S_{u2}$ and the switch $S_{u1}$ are each connected to the energy recovery unit.

The energy recovery unit includes an energy accumulation block, a path switching block, a plurality of inductors, and a plurality of diodes.

More specifically, the energy accumulation block includes four capacitors $C_{d1}$, $C_{d2}$, $C_{u2}$, and $C_{u1}$ connected in series. One end of the switch $C_{d1}$ is connected to the ground line. One end of the switch $C_{u1}$ is connected to the supply voltage $+V_s$.

The path switching block includes a plurality of diodes $D_{r1}$, $D_{r2}$, $D_{f1}$, $D_{f2}$, $D_u$, and $D_d$, a plurality of switches $S_{r1}$, $S_{f1}$, $S_{r2}$, and $S_{f2}$ that are connected in parallel to the capacitors $C_{d1}$, $C_{d2}$, $C_{u2}$, and $C_{u1}$, respectively. The path switching block switches a current path and forms a resonance path through which current flows via different inductors in the first and second charging modes and the first and second discharging modes, according to an energy recovery sequence.

A plurality of inductors $L_{r1}$, $L_{f1}$, $L_{r2}$ and $L_{f2}$ is connected to a plurality of switches $S_{r1}$, $S_{f1}$, $S_{r2}$, and $S_{f2}$ and forms an LC resonance circuit for energy recovery in the first and second charging modes and the first and second discharging modes.

A plurality of diodes $D_{u1}$, $D_{u2}$, $D_{u3}$, $D_{u4}$, $D_{d1}$, $D_{d2}$, $D_{d3}$, and $D_{d4}$, while connected to both ends of a plurality of inductors $L_{r1}$, $L_{r2}$, $L_{f1}$, and $L_{f2}$, clamps the voltages of switches and forms a path for eliminating a free-wheeling current. In other words, a free-wheeling current is generated in the inductor of the resonance path, due to the parasitic effect during mode transitions. When this occurs, a plurality of diodes $D_{u1}$, $D_{u2}$, $D_{u3}$, $D_{u4}$, $D_{d1}$, $D_{d2}$, $D_{d3}$, and $D_{d4}$ is configured to form a path for discharging the free-wheeling current.

In FIG. 4, the sustain-discharge driving device is represented by only a side 1 electrode of the PDP for the sake of convenience. A side 2 electrode of the PDP is configured in the same manner as the side 1 electrode of the PDP.

Figure 5:
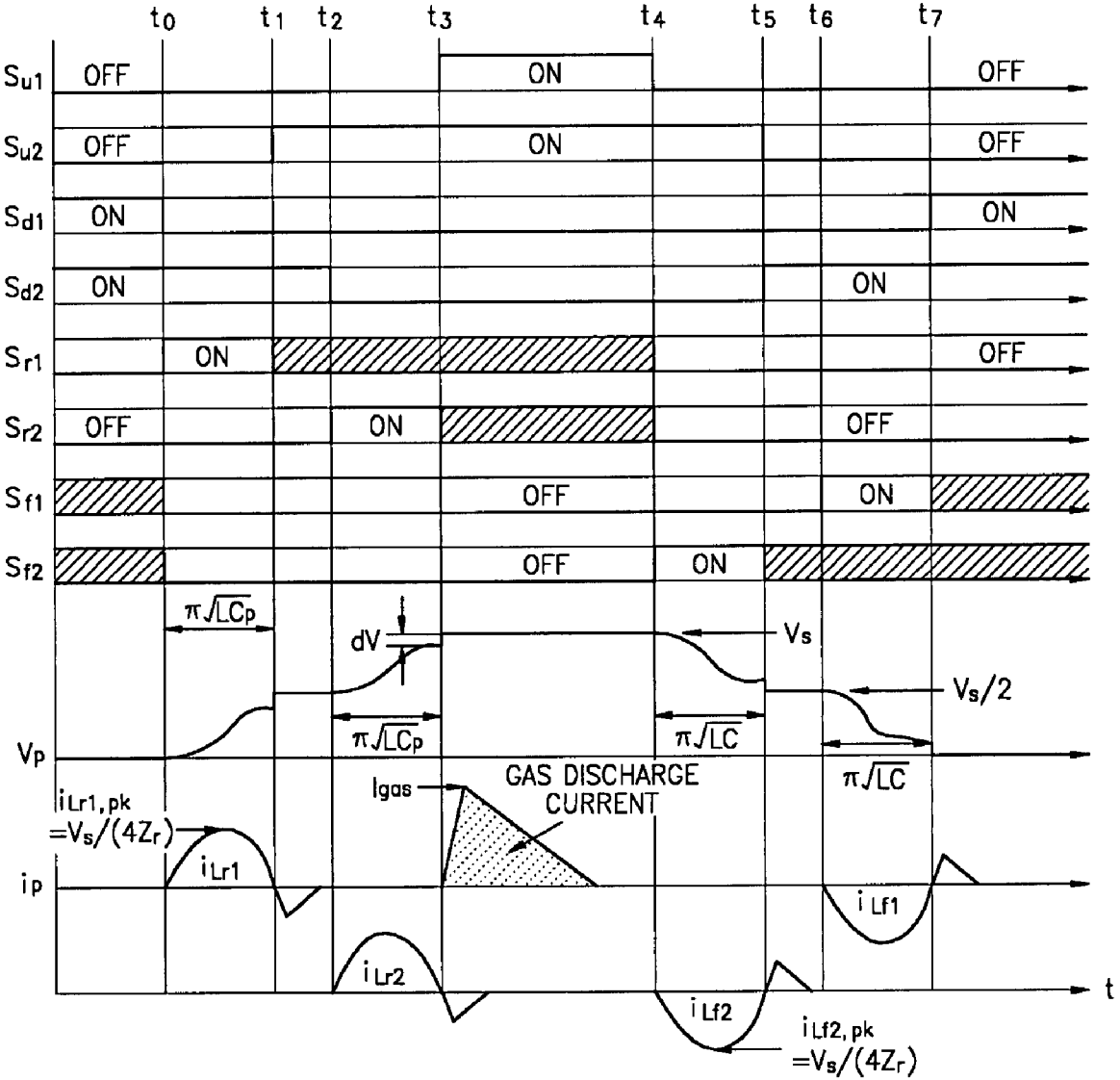
FIG. 5 shows graphs of switching control signals, a voltage, and a current used in the sustain-discharge driving device of FIG. 4.

FIG. 5 shows half period graphs of switch control signals, a voltage, and a current used in the sustain-discharge driving device of FIG. 4, when a switch $S_{d3}$ and a switch $S_{d4}$ of the side 2 electrode of the PDP (see FIG. 7) are turned on, In this scenario, either the side 1 electrode or the side 2 electrode has a ground level potential (GND). In FIG. 5, the hatched sections do not relate to an on or off state of a gate signal. For analysis of the scenario previously described, it is assumed that all both-end voltages at each capacitor in the energy accumulation block are sustained at the voltage $+V_s/4$ and the inductors of the energy recovery unit have the same inductance. FIGS. 6A through 6H show equivalent circuits in each mode of the sustain-discharge driving device of FIG. 4, according to the switching sequence. Hereinafter, the operations of the sustain-discharge driving device of FIG. 4 in each mode will be described with reference to FIGS. 5 through 6H.

1) Mode 1 (Period $t_0$ Through $t_1$; a Precharging Mode)

Just before the time $t_0$, the switch $S_{d1}$ and the switch $S_{d2}$ are turned on, and a panel voltage $V_p$ is sustained at 0V. The drain-source voltages of the switch $S_{u1}$ and the switch $S_{u2}$ are a voltage $+V_s/2$. At the time $t_0$, when the switch $S_{d1}$ is turned off and the switch $S_{r1}$ of the energy recovery unit is turned on, the capacitor $C_p$ (PDP) is charged by the current flowing through the resonance path of the capacitor $C_{d1}$—the switch $S_{r1}$—the inductor $L_{r1}$—the diode $D_{r1}$—the switch $S_{d2}$—the capacitor $C_p$. At this time, the both-end panel voltage $V_p$ increases from 0V to $\{(+V_s/2)-dV\}$. The voltage dV denotes a voltage drop due to a parasitic resistance of the sustain-discharge driving device. At the time $t_1$, when the switch $S_{d2}$ is turned off and the switch $S_{u2}$ is turned on, mode 1 is complete.

2) Mode 2 (Period $t_1$ Through $t_2$; a Voltage $+V_s/2$ Mode)

Figure 6A:
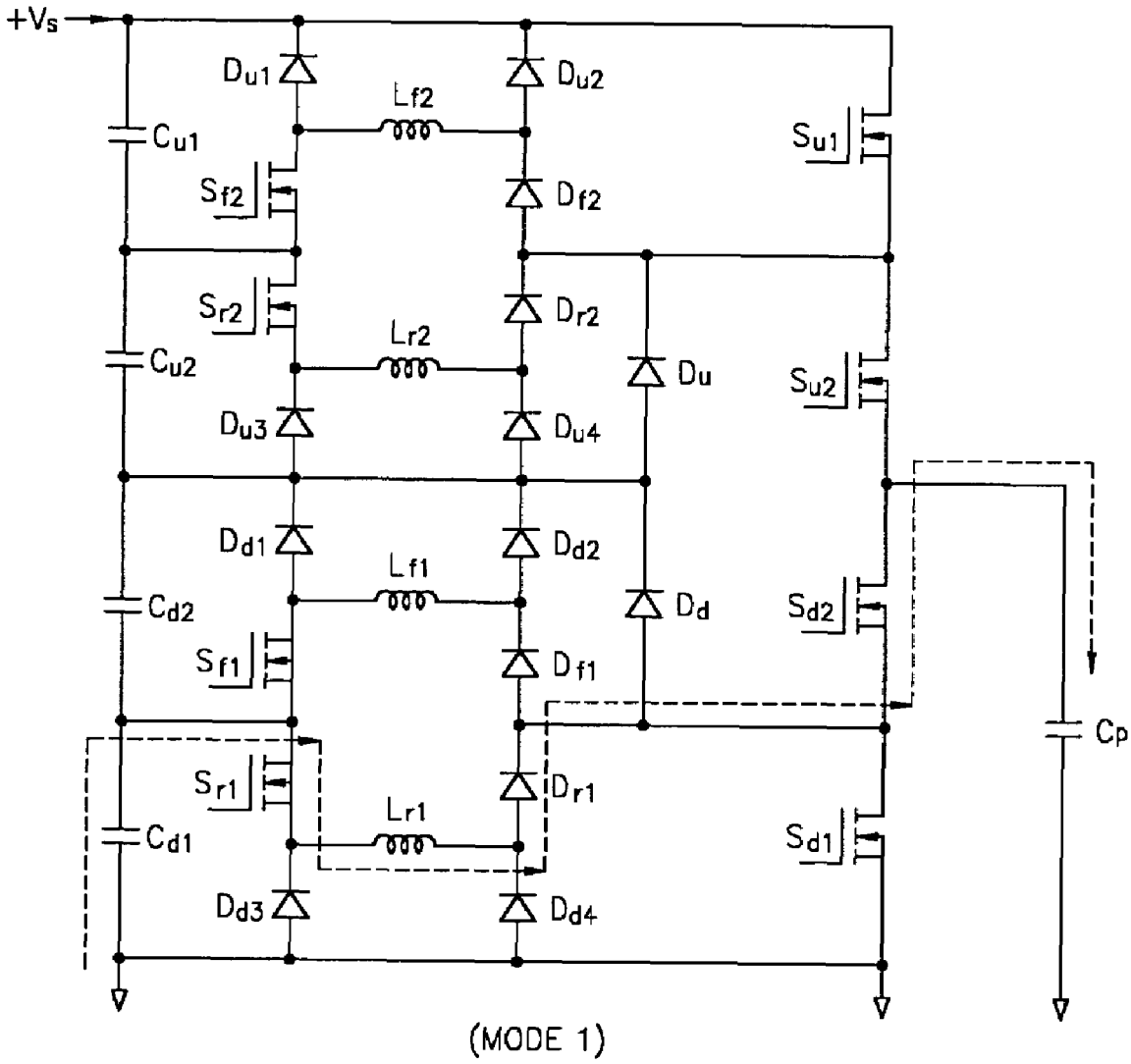
FIGS. 6A through 6H show paths through which current flows according to the switching sequence, in each mode of the sustain-discharge driving device of FIG. 4.
Figure 6B:
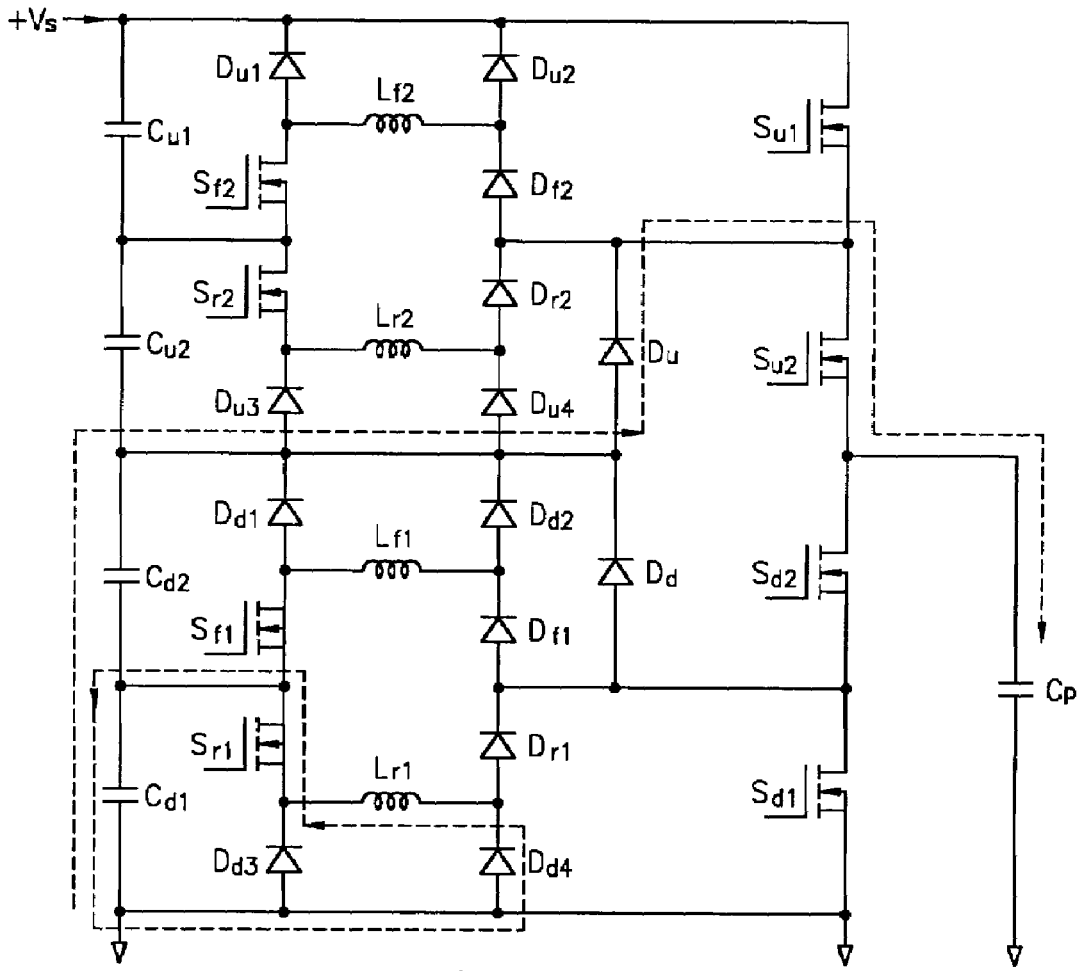

As shown in FIG. 5, at the time $t_1$, the switch $S_{d2}$ is turned off and the switch $S_{u2}$ is turned on. The panel voltage $V_p$ is sustained at the voltage $+V_s/2$. The diode $D_{d4}$ is turned on as a result of the parasitic current (free-wheeling current) generated due to reverse recovery of the diode $D_{r1}$, which is caused by the voltage drop of dV. As shown in FIG. 6B, the parasitic current is confined to the path of the diode $D_{d4}$—the inductor $L_{r1}$—the switch $S_{r1}$—the capacitor $C_{d1}$ to suppress surge voltages of the switches. The both-end voltage at the inductor $L_{r1}$ becomes the voltage $+V_s/4$, and thus, the parasitic current decreases rapidly at a ratio of $-V_s$ to $4L_{r1}$. In contrast, according to the conventional PDP sustain-discharge driver, the both-end voltage at the inductor is about 2V, and thus, the parasitic current decreases slowly at a ratio of −2V to 1L.

3) Mode 3 (Period $t_2$ Through $t_3$; a Post-Charging Mode)

Figure 6C:
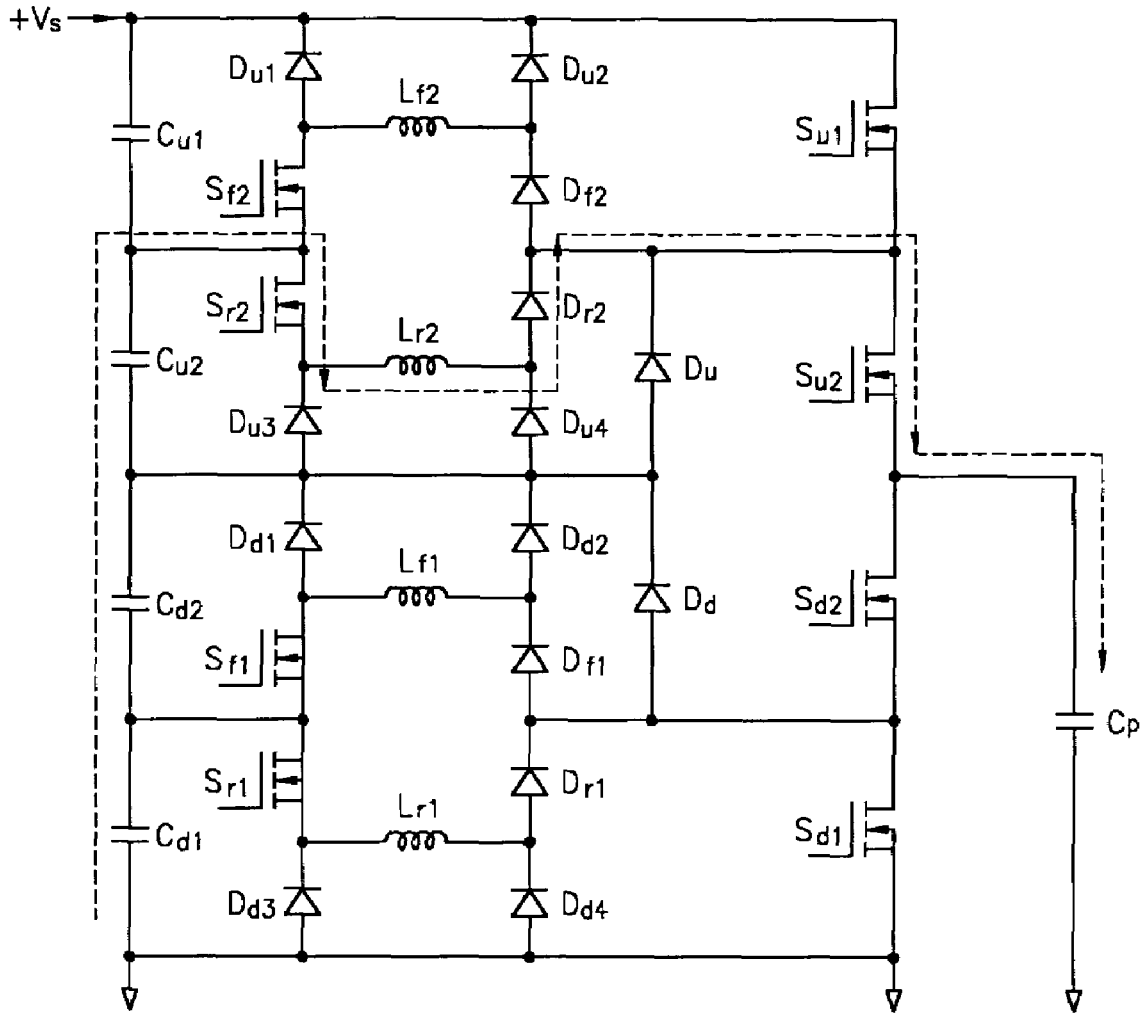

At the time $t_2$, mode 3 starts once the switch $S_{r2}$ is turned on. Then, as shown in FIG. 6C, the panel voltage $V_p$ increases from the voltage $+V_s/2$ to $(+V_s-dV)$, due to a current flowing through the resonance path of the capacitor $C_{d1}$—the capacitor $C_{d2}$—the capacitor $C_{u2}$—the switch $S_{r2}$—the inductor $L_{r2}$—the diode $D_{r2}$—the switch $S_{u2}$—the capacitor $C_p$. At the time $t_3$, mode 3 is complete once the switch $S_{u1}$ is turned on.

4) Mode 4 (Period $t_3$ Through $t_4$; a Light Emission Mode)

Figure 6D:
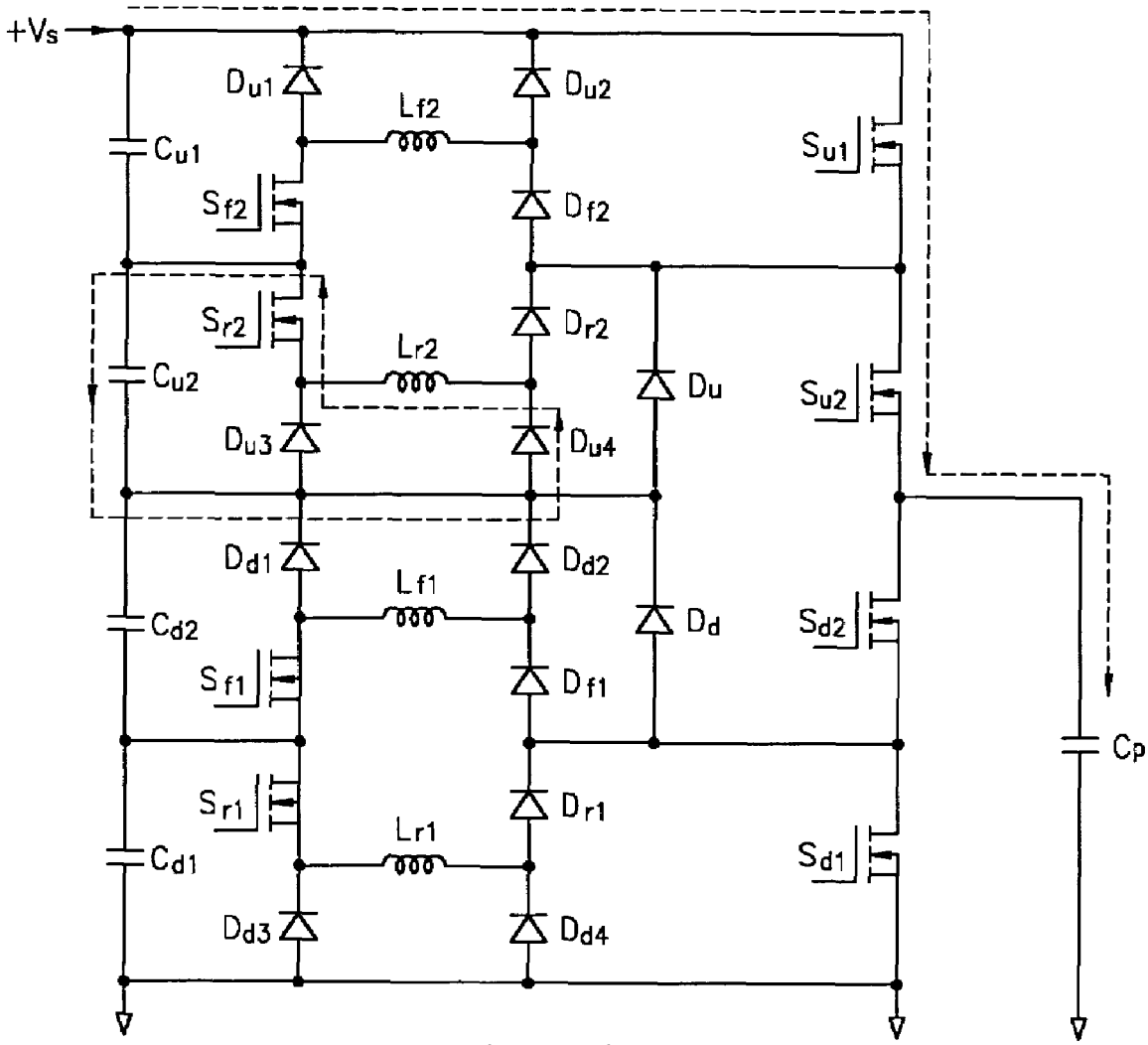

At the time $t_3$, the switch $S_{u1}$ is turned on. As shown in FIG. 5, in mode 4, the panel voltage $V_p$ is sustained at the voltage $V_s$, and a sustain-discharge current of the PDP flows through the switch $S_{u1}$. The duration of mode 4 is determined in relation to discharging substances of the PDP. In general, mode 4 lasts for more than 1.7 us. The diode $D_{u4}$ is turned on by the parasitic current (free-wheeling current) generated due to reverse recovery of the diode $D_{r2}$, which is caused by the voltage drop of dV. As shown in FIG. 6D, the parasitic current is confined to the path of the diode $D_{u4}$—the inductor $L_{r2}$—the switch $S_{r2}$—the capacitor $C_{u2}$ to suppress surge voltages of the switches. The both-end voltage at the inductor $L_{r2}$ becomes the voltage $+V_s/4$, and thus, the parasitic current decreases rapidly at a ratio of $-V_s$ to $4L_{r2}$. In contrast, according to the conventional PDP sustain-discharge driver, the inductor both-end voltage is about 2V, and thus, the parasitic current decreases slowly at a ratio of −2V to 1L.

5) Mode 5 (Period $t_4$ Through $t_5$; a Pre-discharging Mode)

Figure 6E:
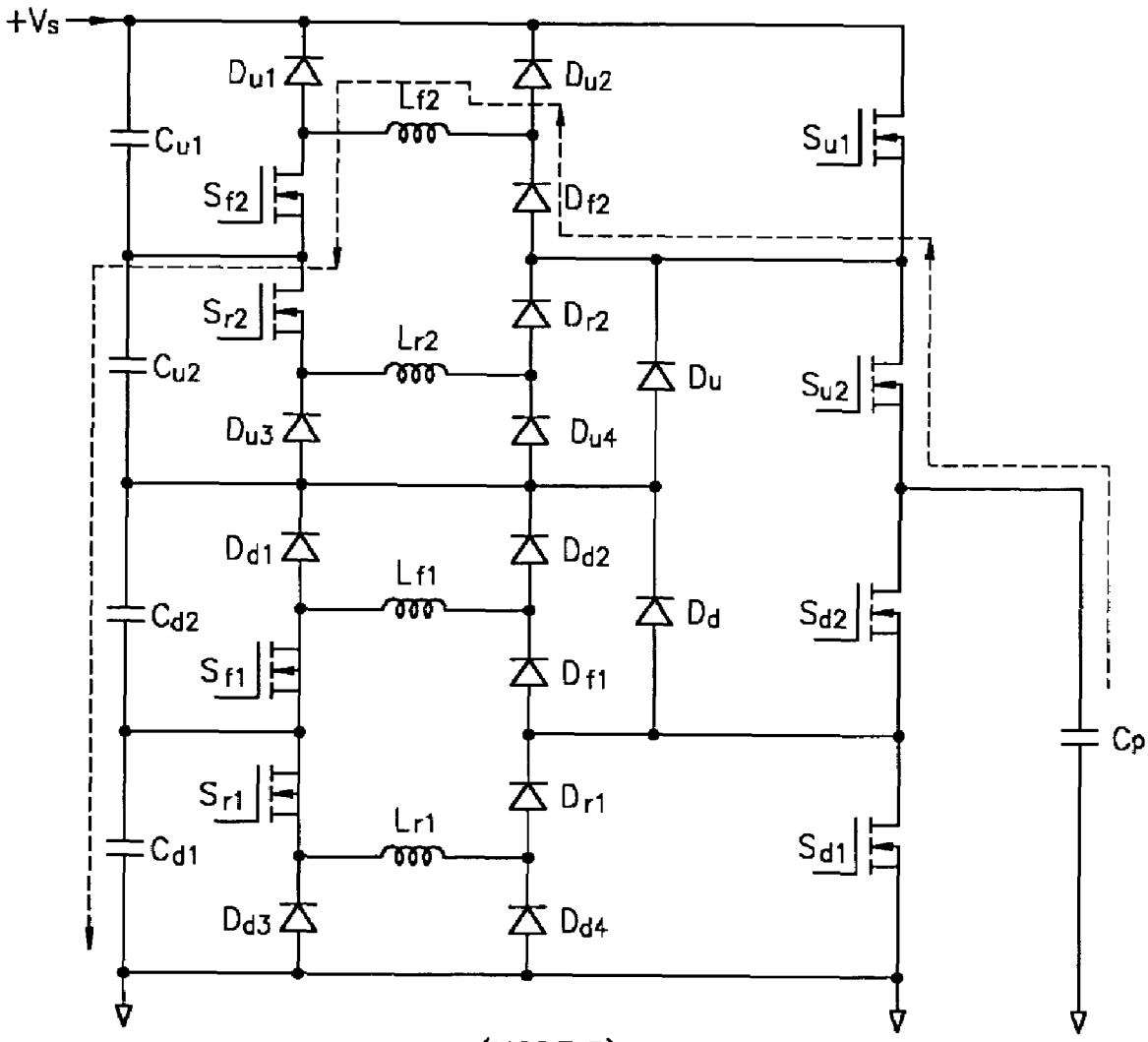

At the time $t_4$, the switch $S_{u1}$ is turned off and the switch $S_{f2}$ is turned on. Thus, as shown in FIG. 6E, the panel is discharged through the resonance path of the capacitor $C_p$—the switch $S_{u2}$—the diode $D_{f2}$—the inductor $L_{f2}$—the switch $S_{f2}$—the capacitor $C_{u2}$—the capacitor $C_{d2}$—the capacitor $C_{d1}$. The panel voltage $V_p$ decreases from the voltage $+V_s$ to the voltage $\{(+V_s/2)+dV\}$. At the time $t_5$, the switch $S_{u2}$ is turned off, and mode 5 is complete.

6) Mode 6 (Period $t_5$ Through $t_6$; a Voltage $+V_s/2$ Mode)

Figure 6F:
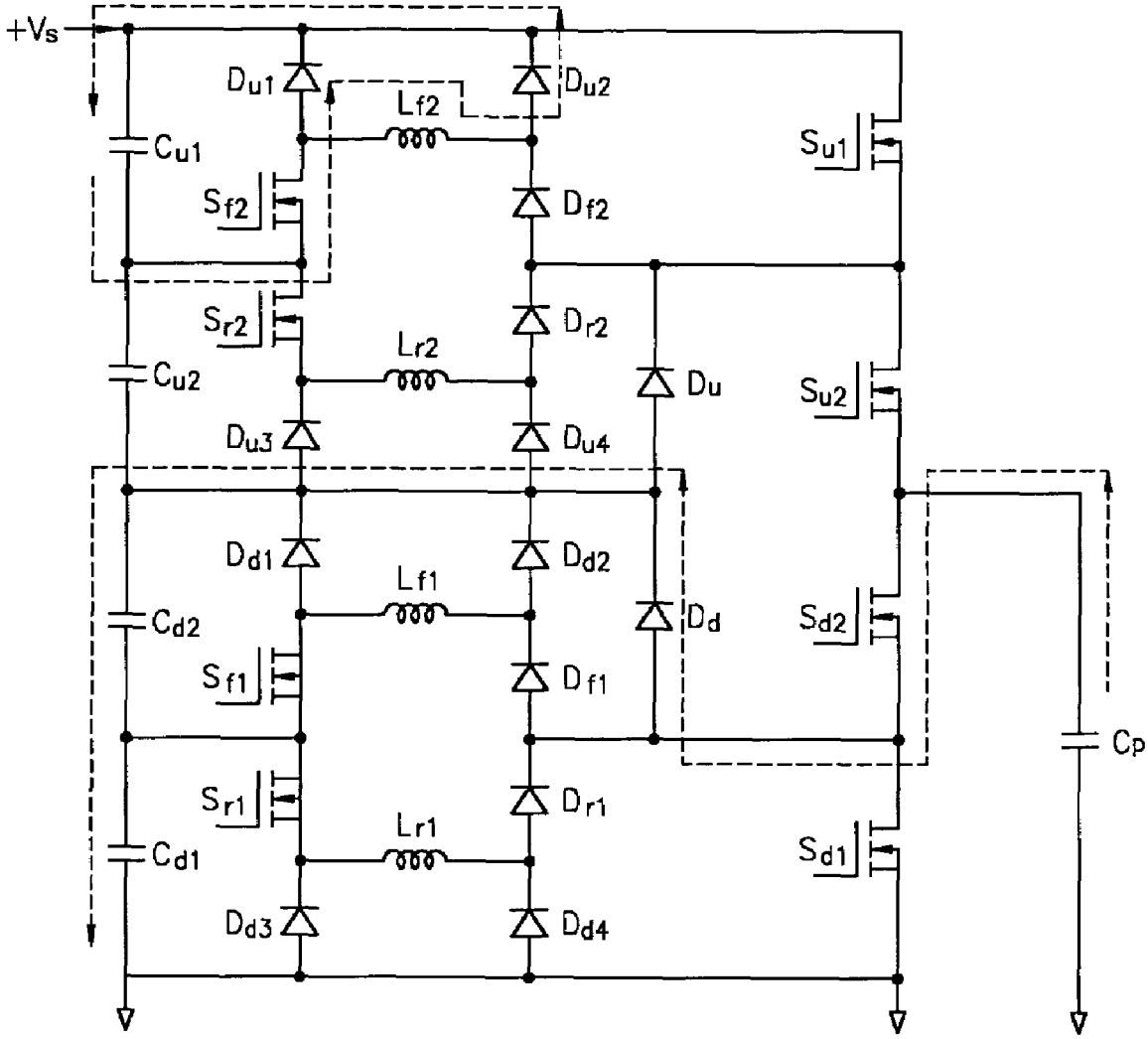

As shown in FIG. 5, at the time $t_5$, the switch $S_{u2}$ is turned off and the panel voltage $V_p$ is sustained at the voltage $+V_s/2$. The diode $D_{u2}$ is turned on by the parasitic current (free-wheeling current) generated due to reverse recovery of the diode $D_{f2}$, which is caused by the voltage drop of dV. As shown in FIG. 6F, the parasitic current is confined to the path of the switch $S_{f2}$—the inductor $L_{f2}$—the diode $D_{u2}$—the capacitor $C_{u1}$ to suppress surge voltages of the switches. The both-end voltage at the inductor $L_{f2}$ becomes the voltage $+V_s/4$, and thus, the parasitic current decreases rapidly at a ratio of $-V_s$ to $4L_{f2}$. In contrast, according to the conventional PDP sustain-discharge driver, the inductor both-end voltage is about 2V, and thus, the parasitic current decreases slowly at a ratio of −2V to 1L.

7) Mode 7 (Period $t_6$ Through $t_7$; a Post-Discharging Mode)

Figure 6G:
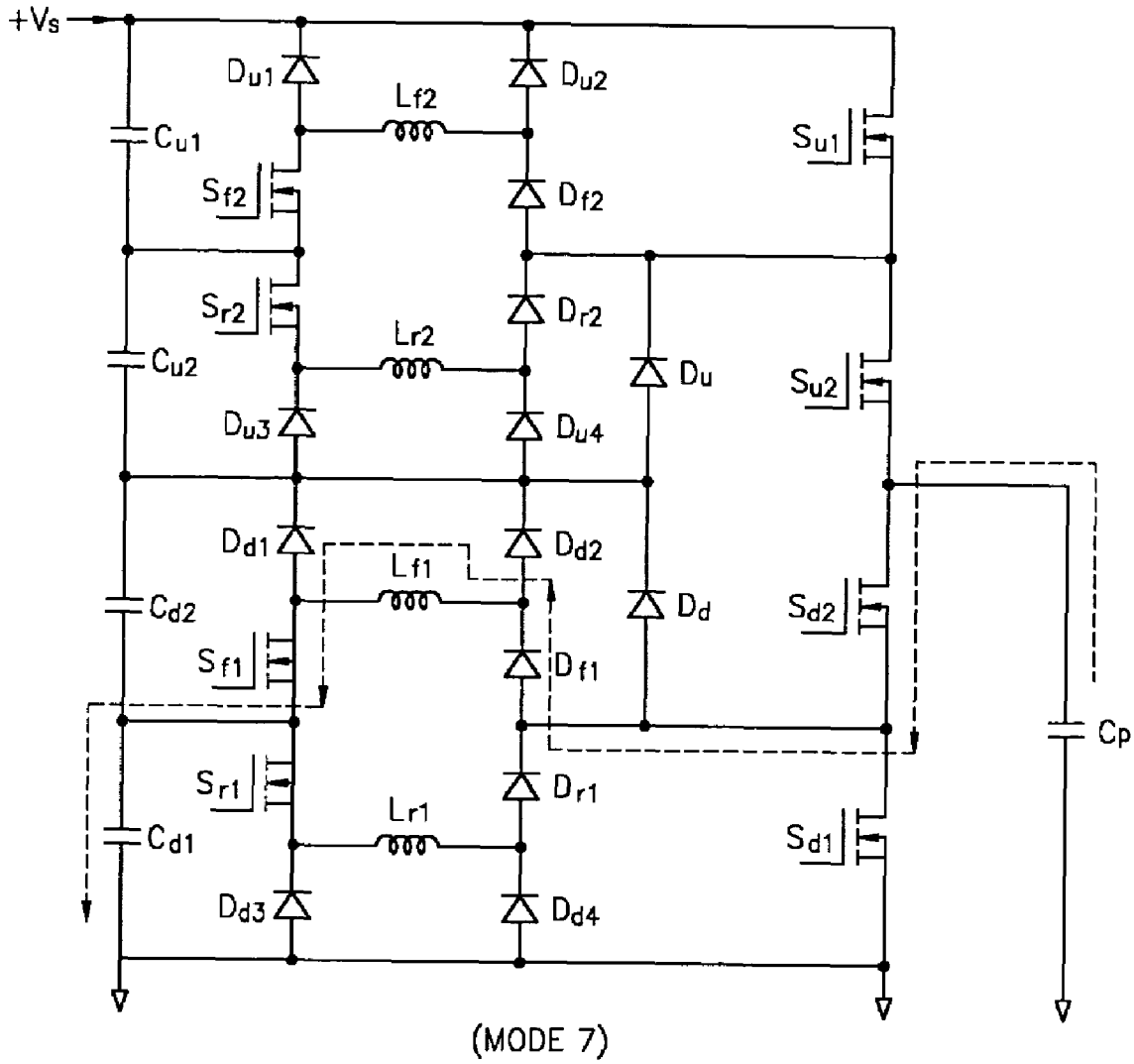

At the time $t_6$, once the switch $S_{f1}$ is turned on, mode 7 starts. As shown in FIG. 6G, the panel voltage $V_p$ decreases from the voltage $+V_s/2$ to the voltage +dV through the resonance path of the capacitor $C_p$—the switch $S_{d2}$—the diode $D_{f1}$—the inductor $L_{f1}$—the switch $S_{f1}$—the capacitor $C_{d1}$. At the time $t_7$, once the switch $S_{d1}$ is turned on, mode 7 is complete.

8) Mode 8 (Period $t_7$ Through $t_8$; a Ground Mode)

Figure 6H:
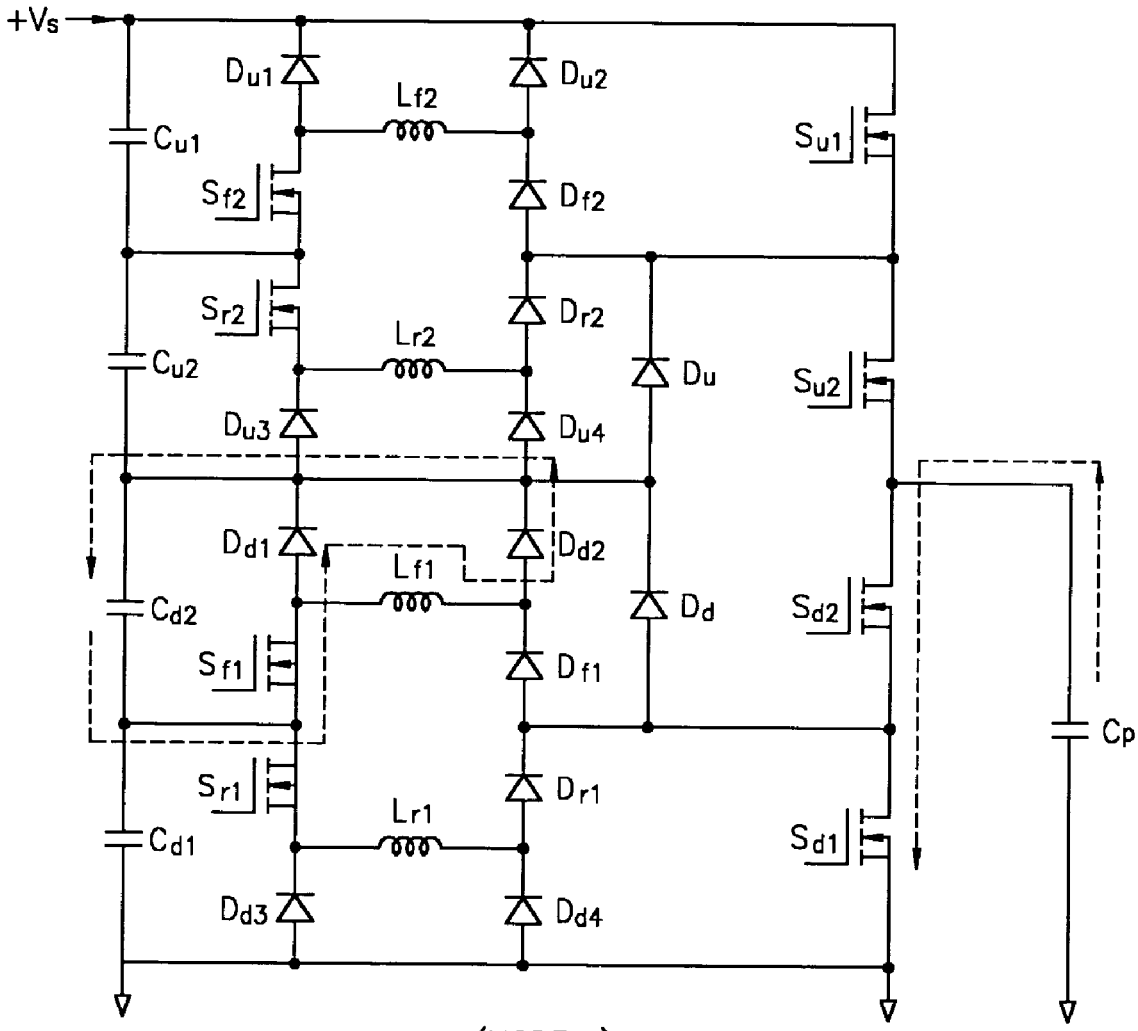

As shown in FIG. 5, at the time $t_7$, the switch $S_{d1}$ is turned on and the panel voltage $V_p$ becomes 0V. The diode $D_{d2}$ is turned on by the parasitic current (free-wheeling current) generated due to reverse recovery of the diode $D_{f1}$, which is caused by the voltage drop of dV. As shown in FIG. 6H, the parasitic current is confined to the path of the switch $S_{f1}$—the inductor $L_{f1}$—the diode $D_{d2}$—the capacitor $C_{d2}$ to suppress surge voltages of the switches. The both-end voltage at the inductor $L_{f1}$ becomes the voltage $V_s/4$, and thus, the parasitic current decreases rapidly at a ratio of $-V_s$ to $4L_{f1}$. In contrast, according to the conventional PDP sustain-discharge driver, the inductor both-end voltage is about 2V, and thus, the parasitic current decreases slowly at a ratio of −2V to 1L.

In the manner described above, the side 2 sustain-discharge driver repeats modes 1 through 8 and applies a high-frequency AC voltage to the PDP.

Figure 7:
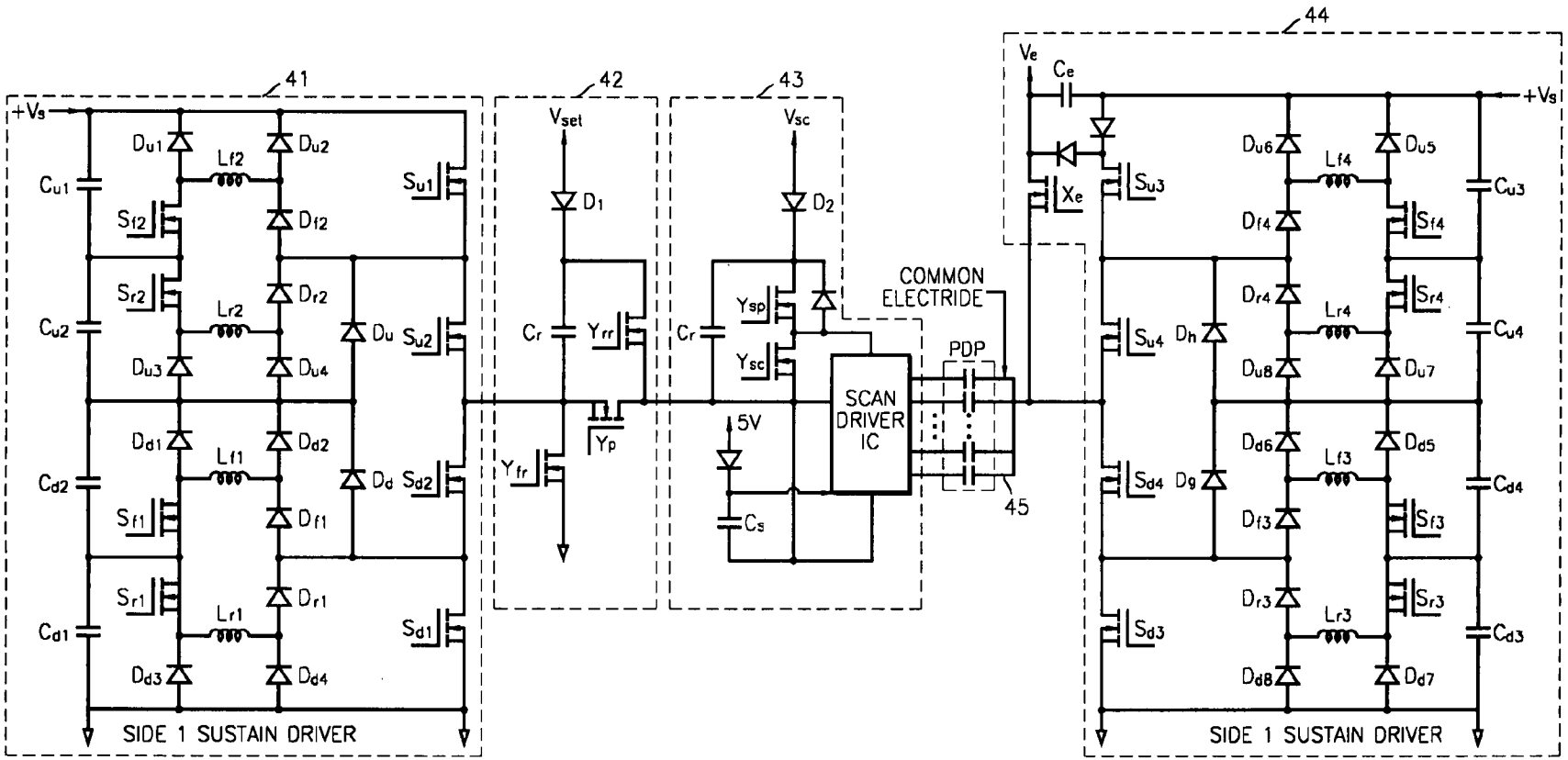
FIG. 7 shows a PDP driving system according to the present invention.

FIG. 7 shows a PDP driving system using the sustain-discharge driving device of the high-efficiency PDP, shown in FIG. 4. The PDP driving system includes a Y electrode sustain-discharge driving circuit 41, a separation and reset circuit 42, a scan pulse generating circuit 43, an X electrode sustain-discharge driving circuit 44, and a plasma display panel (PDP) 45.

The Y electrode sustain-discharge driving circuit 41 and the X electrode sustain-discharge driving circuit 44 have already been described in FIG. 4 and will not be described here.

A switch $Y_p$ of the separation and reset circuit 42 is a switch circuit for separating circuit operations, during a sustain period, from circuit operations during other periods such as an address period and a reset period. Switches $Y_{fr}$ and $Y_{rr}$ of the separation and reset circuit 42 are switch circuits for applying a ramp-type high voltage to the PDP 45 during the reset period.

The scan pulse generating circuit 43 applies a horizontal synchronization signal to the PDP 45 during the address period, which is shortened during other periods.

Similar to the modes of the device in the FIG. 4, the charging and discharging modes during the sustain period are respectively divided into two modes, i.e., a pre-charging and post-charging mode in the charging-mode, and a pre-discharging and post-discharging mode in the discharging mode. The pre-charging and post-charging mode constitute a pair, while the pre-discharging and post-discharging mode constitute a pair. In each pair, a resonance path is formed through one of the inductors $L_{r1}$, $L_{f1}$, $L_{r2}$, and $L_{f2}$, such that the voltage stress applied to a semiconductor device is reduced. Also, by quickly eliminating the free-wheeling current, the voltage stress applied to the semiconductor device is reduced.

As described above, according to the present invention, the sustain-discharge driving device of the PDP is designed to create a closed circuit in which the voltage difference between both ends of the inductor is greater than a predetermined value, thereby quickly eliminating the free-wheeling current, which is generated in the inductor of the resonance path due to a parasitic effect, during mode transition. Therefore, it is possible to reduce the current stress applied to the switches. Also, the power consumption due to the free-wheeling current can be reduced, and the timing sequence of the gate signal can be easily controlled.

A method, a device, a system, etc. can implement the present invention. When the present invention is implemented through software, code segments executing essential operations constitute the present invention. Programs or code segments are stored in a processor readable medium or transmitted by a computer data signal combined with carrier waves through a transmission medium or a communication network. The processor readable medium includes media capable of storing or transmitting information, such as electronic circuits, semiconductor memory devices, ROMs, flash memory, $E^2$PROMs, floppy disks, optical disks, hard disks, optical fabric media, and radio frequency (RF) networks. The computer data signal includes signals that can be transmitted through media such as electronic network channels, optical fabrics, air, electric fields, and RF networks.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A sustain-discharge driving device of a high-efficiency plasma display panel (PDP), the sustain-discharge driving device comprising:

a sustain-discharge switching unit, which connects charging and discharging paths of an energy recovery unit to the PDP, according to a sustain-discharge sequence; and the energy recovery unit, which, according to an energy recovery sequence, discharges energy of the PDP to an energy accumulation device through a resonance path while in dis-charging mode, charges the PDP with the energy accumulated in the energy accumulation device through a resonance path while in charging mode, and forms a closed circuit in which a voltage difference between both ends of an inductor is greater than a predetermined value, so as to eliminate a free-wheeling current, which is generated in the inductor of the resonance path due to a parasitic effect, during mode transition;

wherein the charging mode comprises a first charging mode and a second charging mode the discharging mode comprises a first discharging mode and a second discharging mode, and different resonance paths are formed in the first charging mode and the second charging mode and in the first discharging mode and the second discharging mode.

2. The sustain-discharge driving device of claim 1, wherein the energy recovery sequence is configured such that durations of the first charging mode and the second charging mode are identical to each other.

3. The sustain-discharge driving device of claim 1, wherein the energy recovery sequence is configured such that durations of the first discharging mode and the second discharging mode are identical to each other.

4. The sustain-discharge driving device of claim 1, wherein the charging mode and the discharging mode include a mode in which a path, not caused by any inductor, is formed to separate the first charging mode from the second charging mode and separate the first discharging mode from the second discharging mode.

5. The sustain-discharge driving device of claim 1, wherein the energy recovery unit includes four inductors which form resonance paths, caused by different inductors, in the first charging mode and the second charging mode, and in the first discharging mode and the second discharging mode.

6. The sustain-discharge driving device of claim 1, wherein the sustain-discharge switching unit which includes first, second, third, and fourth switches ($Sd_{d1}$, $Sd_{d2}$, $S_{u2}$, $S_{u1}$) connected in series, connects one end of the first switch to a ground line and one end of the fourth switch to a supply voltage, connects a contact point of the second switch and the third switch to the PDP, and connects a contact point of the first switch and the second switch and a contact point of the third switch and the fourth switch to different ends of the energy recovery unit.

7. The sustain-discharge driving device of claim 6, wherein the sustain-discharge sequence is configured such that the second switch is turned on and other switches are turned off in the first charging mode, and the third switch is turned on and the other switches are turned off in the second charging mode.

8. The sustain-discharge driving device of claim 6, wherein the sustain-discharge sequence is configured such that the third switch is turned on and other switches are turned off in the first discharging mode, and the second switch is turned on and the other switches are turned off in the second discharging mode.

9. The sustain-discharging driving device of claim 1, wherein the energy recovery unit comprises:

an energy accumulation device block, which has first through fourth capacitors ($C_{d1}$, $C_{d2}$, $C_{u2}$, $C_{u1}$) connected in series and connects one end of the first capacitor to a ground line and one end of the fourth capacitor to a supply voltage;

a path switching block, which is connected to the first through fourth capacitors in parallel and includes a plurality of switches ($S_{r1}$, $S_{f1}$, $S_{r2}$, $S_{f2}$) and a plurality of diodes ($D_{r1}$, $D_{f1}$, $D_{r2}$, $D_{f2}$, $D_u$, and $D_d$) for forming a current path, including different inductors ($L_{r1}$, $L_{f1}$, $L_{r2}$, and $L_{f2}$) in the first charging mode and the second charging mode, and in the first discharging mode and the second discharging mode, according to the energy recovery sequence;

a plurality of inductors connected to a plurality of switches to form resonance paths in the first charging mode, the second charging mode, the first discharging mode, and the second discharging mode; and a plurality of diodes ($D_{u1}$, $D_{u2}$, $D_{u3}$, $D_{u4}$, $D_{d1}$, $D_{d2}$, $D_{d3}$, and $D_{d4}$), is connected to respective both ends of the inductors, clamps voltages of the switches, and forms a path for eliminating the free-wheeling current, wherein the energy recovery unit arranges circuit components to form a free-wheeling current flow path in which the voltage difference between both ends of the inductor is greater than a predetermined value, the free-wheeling current generated in the resonance path caused by the inductor due to the parasitic effect in mode transition.

10. The sustain-discharge driving device of claim 9, wherein in the first charging mode, the energy recovery unit turns on a switch $S_{d2}$ and the switch $S_{r1}$ so that the PDP is charged with an energy accumulated in the capacitor $C_{d1}$ through an LC resonance path of $C_{d1}$-$S_{r1}$-$L_{r1}$-$D_{r1}$-$S_{d2}$-$C_p$ ($C_p$ denotes a panel capacitor), and at end of the first charging mode, the energy recovery unit has circuit components arranged to eliminate the free-wheeling current, which is generated due to the parasitic effect, through a path of $D_{d4}$-$L_{r1}$-$S_{r1}$-$C_{d1}$.

11. The sustain-discharge driving device of claim 9, wherein in the second charging mode, the energy recovery unit turns on a switch $S_{u2}$ and the switch $S_{r2}$ so that the PDP is charged with energy accumulated in the capacitors $C_{d1}$, $C_{d2}$, and $C_{u2}$ through an LC resonance path of $C_{d1}$-$C_{d2}$-$C_{d3}$-$S_{r2}$-$L_{r2}$-$D_{r2}$-$S_{u2}$-$C_p$ ($C_p$ denotes a panel capacitor), and at the end of the second charging mode, the energy recovery unit arranges circuit components to eliminate the free-wheeling current, which is generated due to the parasitic effect, through a path of $D_{u4}$-$L_{r2}$-$S_{r2}$-$C_{u2}$.

12. The sustain-discharge driving device of claim 9, wherein in the first discharging mode, the energy recovery unit turns on a switch $S_{u2}$ and the switch $S_{f2}$ so that energy charged in the PDP is discharged to the capacitors $C_{u2}$, $C_{d2}$, and $C_{d1}$ through an LC resonance path of $C_p$-$S_{u2}$-$D_{f2}$-$L_{f2}$-$C_{u2}$-$C_{d2}$-$C_{d1}$, and at the end of the first discharging mode, the energy recovery unit arranges circuit components to eliminate the free-wheeling current, which is generated due to the parasitic effect, through a path of $S_{f2}$-$L_{f2}$-$D_{u2}$-$C_{u1}$.

13. The sustain-discharge driving device of claim 9, wherein in the second discharging mode, the energy recovery unit turns on a switch $S_{d2}$ and the switch $S_{f1}$ so that energy charged in the PDP is discharged to the capacitor $C_{d1}$ through an LC resonance path of $C_p$-$S_{u2}$-$D_{d2}$-$L_{f1}$-$S_{f1}$-$C_{d1}$, and at the end of the second discharging mode, the energy recovery unit has circuit components arranged to eliminate the free-wheeling current, which is generated due to the parasitic effect, through a path of $S_{f1}$-$L_{f1}$-$D_{d2}$-$C_{d2}$.

14. A method of designing a sustain-discharge driving device of a plasma display panel (PDP) having a switching sequence that repeats reset, address, and sustain periods, wherein the sustain-discharge driving device is designed to form a free-wheeling current flow path in which the voltage difference between both ends of the inductor is greater than a predetermined value, and eliminating the free-wheeling current generated in an inductor of the resonance path due to the parasitic effect during mode transition;

wherein the sustain-discharge device has a charging mode which is divided into a first charging mode and a second charging mode, and a discharging mode which is divided into a first discharging mode and a second discharging mode, and wherein different resonance paths are formed in the first and second charging modes and in the first and second discharging modes.

15. The method of claim 14, wherein the energy recovery sequence is configured such that durations of the first charging mode and the second charging mode are identical to each other.

16. The method of claim 14, wherein the energy recovery sequence is configured such that durations of the first discharging mode and the second discharging mode are identical to each other.

17. The method of claim 14, wherein the charging mode and the discharging mode include a mode in which a path, not caused by any inductor, is formed to separate the first charging mode from the second charging mode and separate the first discharging mode from the second discharging mode.

18. The method of claim 14, wherein the energy recovery sequence is configured such that half of a maximum charging voltage charges the PDP in the first charging mode and the second charging mode, respectively.

19. The method of claim 14, wherein the energy recovery sequence is configured such that half of a maximum charging voltage discharges the PDP in each of the first discharging mode and the second discharging mode, respectively.

20. A plasma display panel (PDP) driving system which repeats reset, address, and sustain-discharge periods according to a switching sequence, the PDP driving system comprising:

a Y electrode sustain-discharge driving circuit, which applies a high frequency voltage of rectangular waveform to a Y electrode of the PDP, by dividing a charging mode into a first charging mode and a second charging mode, and by dividing a discharge mode into a first discharging mode and a second discharging mode, directs the Y electrode of the PDP to be charged and/or discharged through a resonance path caused by different inductors in the first and second charging modes, and in the first and second discharging modes, and includes a closed circuit in which a voltage difference between both ends of an inductor is greater than a predetermined value so as to eliminate a free-wheeling current, which is generated in the inductor of the resonance path due to a parasitic effect, during mode transition;

a separation and reset circuit, which separates circuit operations, during the sustain period, from circuit operations, during other periods such as the address period and the reset period, and applies a ramp-type high voltage to the PDP during the reset period;

a scan pulse generating circuit, which applies a horizontal synchronization signal during the address period, which is shortened during the other periods; and an X electrode sustain-discharge driving circuit, which applies a high frequency voltage of rectangular waveform to an X electrode of the PDP, by dividing a charging mode into a first charging mode and a second charging mode and by dividing a discharging mode into a first discharging mode and a second discharging mode, directs the first and second charging modes, and in the first and second discharging modes to charge and/or discharge the Y electrode of the PDP through a resonance path including different inductors, and includes a closed circuit in which a voltage difference between both ends of an inductor is greater than a predetermined value, so as to eliminate a free-wheeling current, which is generated in the inductor of the resonance path due to a parasitic effect, during mode transition.

21. The PDP driving system of claim 20, wherein the Y electrode sustain-discharge driving circuit or the X electrode sustain-discharge driving circuit comprises:

a sustain-discharge switching unit, which includes first, second, third, and fourth switches ($S_{d1}$, $S_{d2}$, $S_{u2}$, $S_{u1}$) connected in series, connects one end of the first switch to a ground line and one end of the fourth switch to a supply voltage, connects a contact point of the second switch and the third switch to the PDP, and connects a contact point of the first switch and the second switch and a contact point of the third switch and the fourth switch to different ends of the energy recovery unit;

an energy accumulation device block, which has first through fourth capacitors ($C_{d1}$, $C_{d2}$, $C_{u2}$, $C_{u1}$) connected in series and connects one end of the first capacitor to a ground line and one end of the fourth capacitor to a supply voltage;

a path switching block, which is connected to the first through fourth capacitors in parallel and includes a plurality of switches ($S_{r1}$, $S_{f1}$, $S_{r2}$, $S_{f2}$) and a plurality of diodes ($D_{r1}$, $D_{f1}$, $D_{r2}$, $D_{f2}$, $D_u$, and $D_d$) for forming a current path, including different inductors ($L_{r1}$, $L_{f1}$, $L_{r2}$, and $L_{f2}$) in the first charging mode and the second charging mode, and in the first discharging mode and the second discharging mode, according to the energy recovery sequence;

a plurality of inductors connected to a plurality of switches to form resonance paths in the first charging mode, the second charging mode, the first discharging mode, and the second discharging mode; and a plurality of diodes ($D_{u1}$, $D_{u2}$, $D_{u3}$, $D_{u4}$, $D_{d1}$, $D_{d2}$, $D_{d3}$, and $D_{d4}$), which is connected to respective both ends of the inductors, clamps voltages of the switches, and forms a path for eliminating the free-wheeling current, wherein the energy recovery unit arranges circuit components to form a free-wheeling current flow path in which the voltage difference between both ends of the inductor is greater than a predetermined value, the free-wheeling current generated in the inductor of the resonance path due to the parasitic effect during mode transition.

* * * * *